US007849961B1

(12) United States Patent
Feliciano, Jr. et al.

(10) Patent No.: US 7,849,961 B1
(45) Date of Patent: Dec. 14, 2010

(54) LADDER HAVING AN ATTACHED TRANSPORTATION DEVICE

(76) Inventors: Angel M. Feliciano, Jr., 13254 Homer Glen, Homer Glen, IL (US) 60491; Thomas G. Bryant, Sr., 23808 W. Caton Farm Rd., Plainfield, IL (US) 60586

( * ) Notice: Subject to any disclaimer, the term of this patent is extended or adjusted under 35 U.S.C. 154(b) by 739 days.

(21) Appl. No.: 11/701,257

(22) Filed: Feb. 1, 2007

(51) Int. Cl.
*E06C 1/00* (2006.01)

(52) U.S. Cl. ..... 182/20

(58) Field of Classification Search ..... 182/20
See application file for complete search history.

(56) References Cited

U.S. PATENT DOCUMENTS 535,082 A * 3/1895 Snell ..... 182/21
1,004,284 A * 9/1911 Lehmann ..... 182/214
2,597,902 A * 5/1952 Roketa ..... 182/214
3,612,218 A * 10/1971 Blair et al. ..... 182/127
3,731,947 A * 5/1973 Fontaine ..... 280/641
4,009,762 A * 3/1977 Bjerkgard ..... 182/20
4,428,456 A * 1/1984 Rohde ..... 182/20
5,810,373 A * 9/1998 Miranda ..... 280/47.2
6,681,893 B1 * 1/2004 Coulson ..... 182/107

* cited by examiner

*Primary Examiner*—Alvin C Chin-Shue
(74) *Attorney, Agent, or Firm*—Robert L. Marsh

(57) ABSTRACT

A ladder has a pair of parallel stiles and a plurality of rungs extending between the stiles. Midway along the length of the ladder is a pair of moveable arms having a first end rotatably attached to one of the stiles and a pair of wheels rotatably attached to the second ends thereof. The arms are moveable between a first position in which the axis of the arms are generally parallel to the axis of the stiles and the axle for the wheels attached to the second end is adjacent to the stiles, and a second position in which the second end of the arms and the wheels attached thereto are spaced from the stile for rolling the ladder across the ground.

3 Claims, 14 Drawing Sheets

10
78
98
40
116
100
12
41

138
14'
44'
70'
10'
40'
78'
80'
97'
132'
106'
134'
107'
136'
94'
98'
82'
100'
104'
102'
110'
116'
18'
18'
48'
15'
140
70'

LADDER HAVING AN ATTACHED TRANSPORTATION DEVICE

The present invention is a ladder that has a device for transporting the ladder across ground.

BACKGROUND OF THE INVENTION

Those involved in the service and construction industries are frequently required to move ladders to and from a work site. Service personnel often work alone and as a result the task of moving a long heavy ladder must be undertaken by one person. Even when there are several people on the same work site, the task of transporting a long ladder may fall to a single individual. Frequently, the ladder must be removed from a roof or side rack of a vehicle, which is a difficult task in itself.

Not only is the task of moving a long heavy ladder difficult, injuries occur when one strains to obtain and maintain control of such a long heavy object. It would be desirable therefore to provide a device which will simplify the transporting of a ladder. It would be further desirable to provide a ladder having a transporting device which would collapse against the ladder so that the ladder would be readily transportable to and from a work site, but would not interfere with the use of the ladder when erected against a structure.

SUMMARY OF THE INVENTION

Briefly, the present invention is embodied in a ladder having a pair of parallel stiles and a plurality of rungs extending between the stiles. To facilitate the transportation of the ladder across ground, midway along the length of the ladder is a moveable arm having a first end rotatably attached to one of the stiles and a wheel rotatably attached to the second end thereof. The arm is moveable between a first position in which the axis of the arm is generally parallel to the axis of the stile and the axle for the wheel attached to the second end is adjacent to the stile, and a second position in which the second end of the arm and the wheel attached thereto are spaced from the stile.

In the preferred embodiment, the device is made with a pair of parallel arms, with the first end of the first arm rotatably attached to one stile and the first end of the second arm rotatably attached to the second stile. The arms are adapted to move in parallel from the first position in which both arms are parallel to and adjacent to the length of the stiles, and the second position in which the arms are generally perpendicular to the stiles. A first wheel is rotatably attached to the first arm and a second wheel is rotatably attached to the second arm such that the wheels may be used to transport the ladder across ground.

To retain the first arm in the second position so as to roll the ladder on the first wheel, one end of a locking arm is pivotally connected near the second end of the first arm and the second end of the locking arm is removably attachable to one of the first stiles and a rung of the ladder. The locking arm is moveable between a first position in which the second end of the locking arm is disconnected from both the first stile and the rung, and a second position in which the second end of the locking arm is locked to one of the first stile and a rung of the ladder to retain the first arm in a supporting orientation.

BRIEF DESCRIPTION OF THE DRAWINGS

A better understanding of the present invention will be had after a reading of the following detailed description taken in conjunction with the drawings wherein.

DETAILED DESCRIPTION OF THE INVENTION

Figure 1:
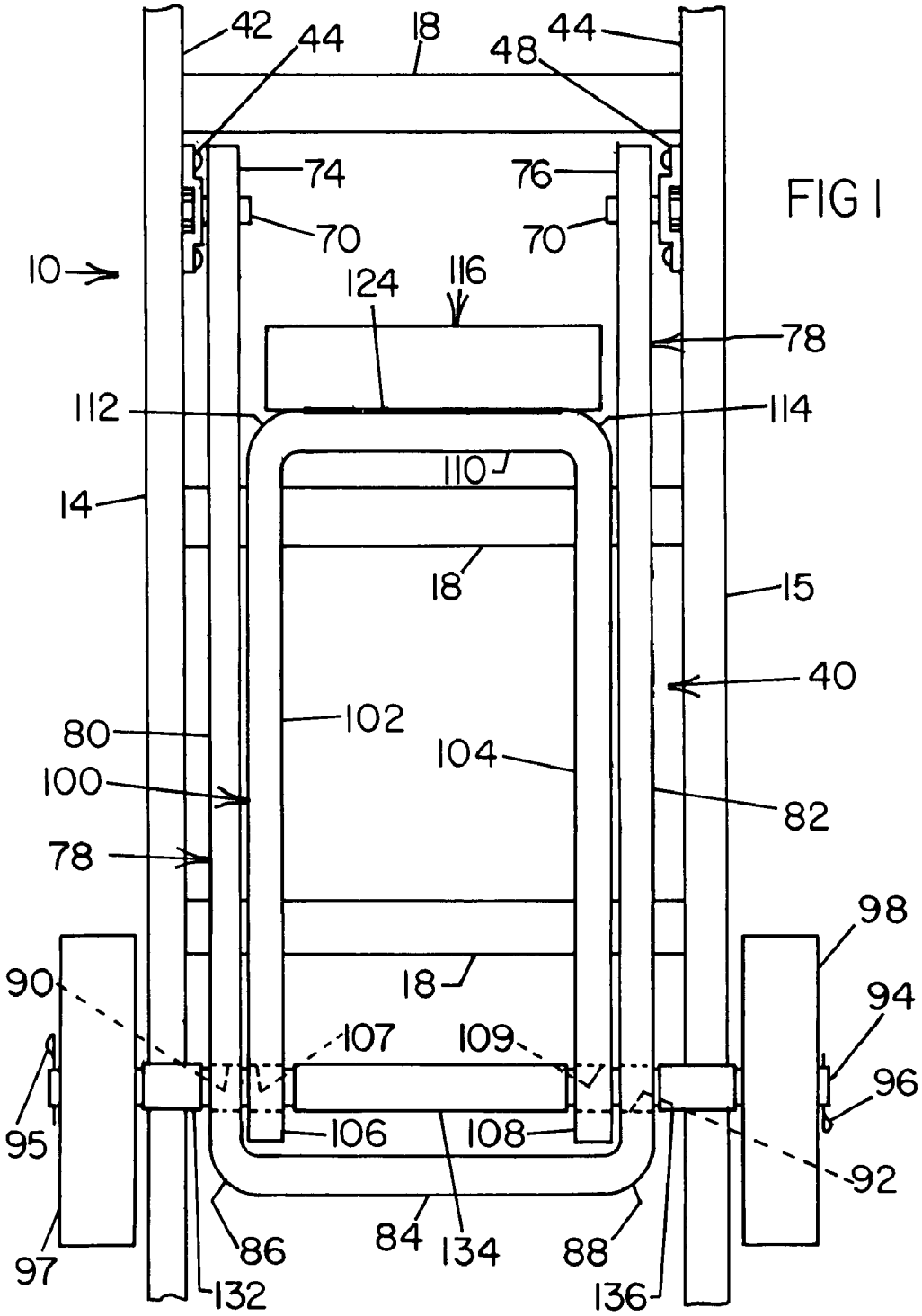
FIG. 1 is a fragmentary front elevational view of a ladder having a transportation device in accordance with the present invention.

Referring to FIGS. 1 through 7, an extension ladder has first and second longitudinally adjustable portions 10, 12 (both portions shown only in FIG. 7) with each of the adjustable portions having a pair of side stiles, the stiles of portion 10 bearing indicia numbers 14 and 15. Extending between the parallel stiles 14, 15 of portion 10 are a plurality of spaced rungs 18-18. The rungs 18-18 of a typical ladder are spaced apart a distance of twelve and fourteen inches, and the spacing may differ from one manufacturer to another within that range. The spacing between adjacent rungs, however, is never less than one foot. The stiles 14, 15 are generally parallel to each other and may taper toward one another gradually along the length of the ladder section 10, 12, however, even at their narrowest spacing the inwardly directed surfaces of adjacent stiles are spaced at least one foot apart.

Figure 5:
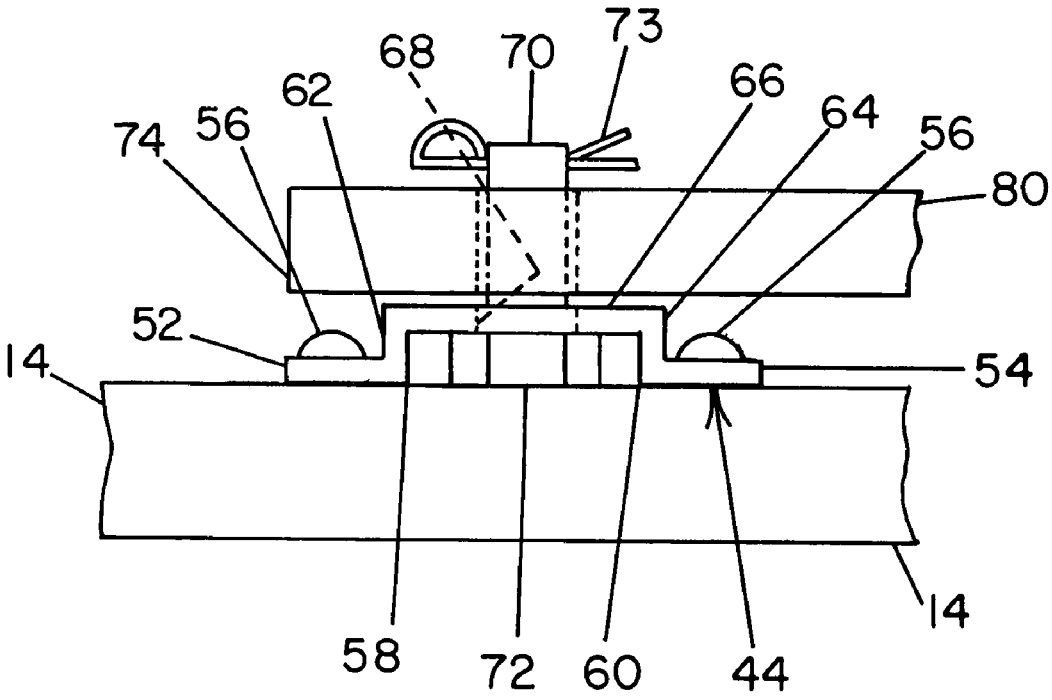
FIG. 5 is a side view of the mounting assembly shown in FIG. 4.
Figure 6:
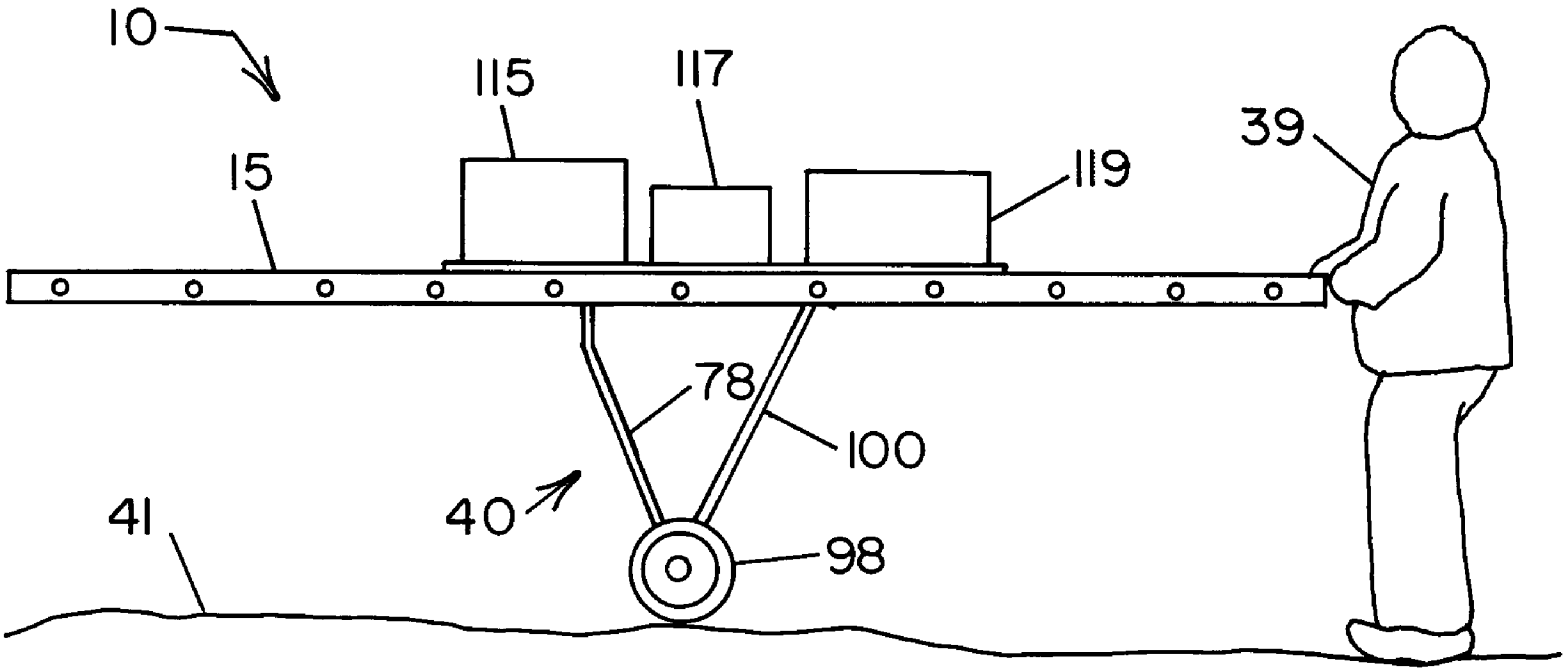
FIG. 6 is a reduced side elevational view of the ladder of FIG. 1 being moved over the ground.
Figure 7:
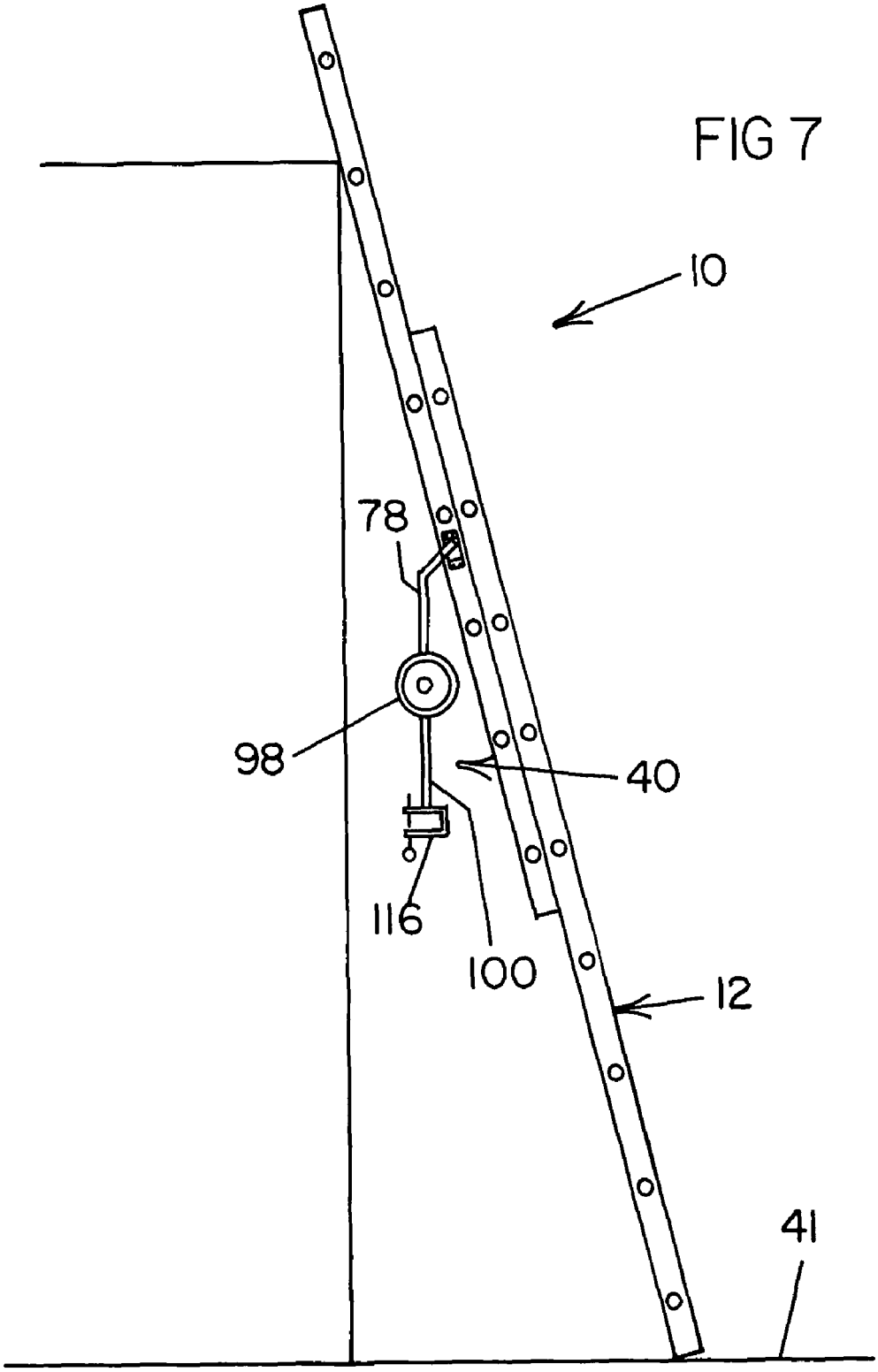
FIG. 7 is another side elevational view of the ladder similar to FIG. 6 but after it has been set up against a structure.

As shown in FIGS. 6 and 7, positioned generally midway along the length of the spaced apart stiles 14, 15 of the first ladder section 10 is a transporting assembly 40 that enables a serviceman 39 to roll the ladder 10, 12 with the stiles of the ladder portions 10 retained generally parallel to the underlying ground 41. As best seen in FIGS. 1 and 5, the device 40 is retained to, the inner surface 42 of stile 14 by a first mounting assembly 44 and to the inner surface 46 of stile 15 by a second mounting assembly 48. As described below, the mounting assemblies 44, 48 pivotally retain the spaced apart distal ends of a U-shaped pivot arm.

Figure 4:
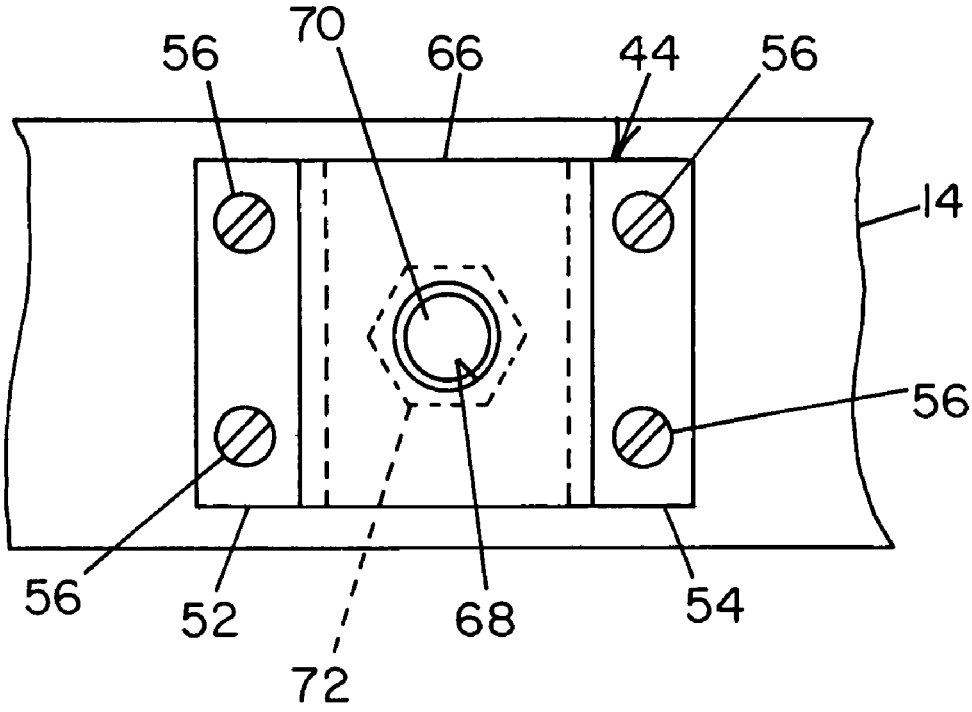
FIG. 4 is a fragmentary enlarged view of the ladder shown in FIG. 1 showing a mounting assembly for retaining the transportation device to the ladder.

As best seen in FIGS. 4 and 5, the pivot mounting 44 includes a pair of co-planar spaced apart mounting plates 52, 54, each of which has a plurality of retaining holes, unnumbered, therein through which mounting screws 56-56 extend to retain the pivot assembly 44 to the associated stile 14, 15. Each of the mounting plates 52, 54 is generally rectangular in shape with an edge 58 of one mounting plate 52 spaced apart from and parallel to an edge 60 of the second mounting plate 54. Extending in a direction perpendicular to the length of the stile 14 are a pair of elevation portions 62, 64 extending from edges 58, 60 of the mounting plates 52, 54 respectively, and joining the outer ends of the parallel elevation portions 62, 64 is a connecting plate 66 having a centrally located transverse hole 68 therein. Extending through the hole 68 is the shank 70 of a bolt having a head 72 trapped in the cavity between the connecting plate 66 and the adjacent stile 14.

The second pivot assembly 48 is identical to the first 44 and all the elements thereof are therefore identical to the elements of the first pivot assembly 44. To the extent that the elements of the second pivot assembly 48 are assigned indicia numbers in the drawings, the indicia numbers given for the second pivot assembly 48 are identical to those of the first pivot assembly 44.

Referring to FIGS. 1, 2, 3 and 5, pivotally mounted to the shanks 70 and retained thereto by retaining pins 73-73 on the two spaced apart pivot assemblies 44, 48 are opposing free ends 74, 76 of a generally U-shaped pivot arm 78 having elongate parallel side portions 80, 82 and a transverse outer end portion 84 generally perpendicular to the side portions 80, 82 and connecting the ends thereof that are furthest from the pivot assemblies 44, 48. Preferably, the pivot arm 78 is made as a single piece of metal with bends 86, 88 defining the junction between the outer end portion 84 and the outer ends of the parallel side portions 80, 82 as depicted. The bends 86, 88 are positioned so that the outside distance between the side portions 80, 82 is less than the inner distance between the stiles 14, 15 so that portions of the U-shaped arms 78 will fit between the stiles 14, 15. The free ends 74, 76 each have transverse holes therein, not clearly visible, for pivotally receiving the shank 70 of the associated pivot assemblies 44, 48. As shown in FIG. 5, the retaining pin 73 at the distal end of each of the shanks 70 prevents the associated free ends 74, 76 from spurious separation therefrom.

Figure 2:
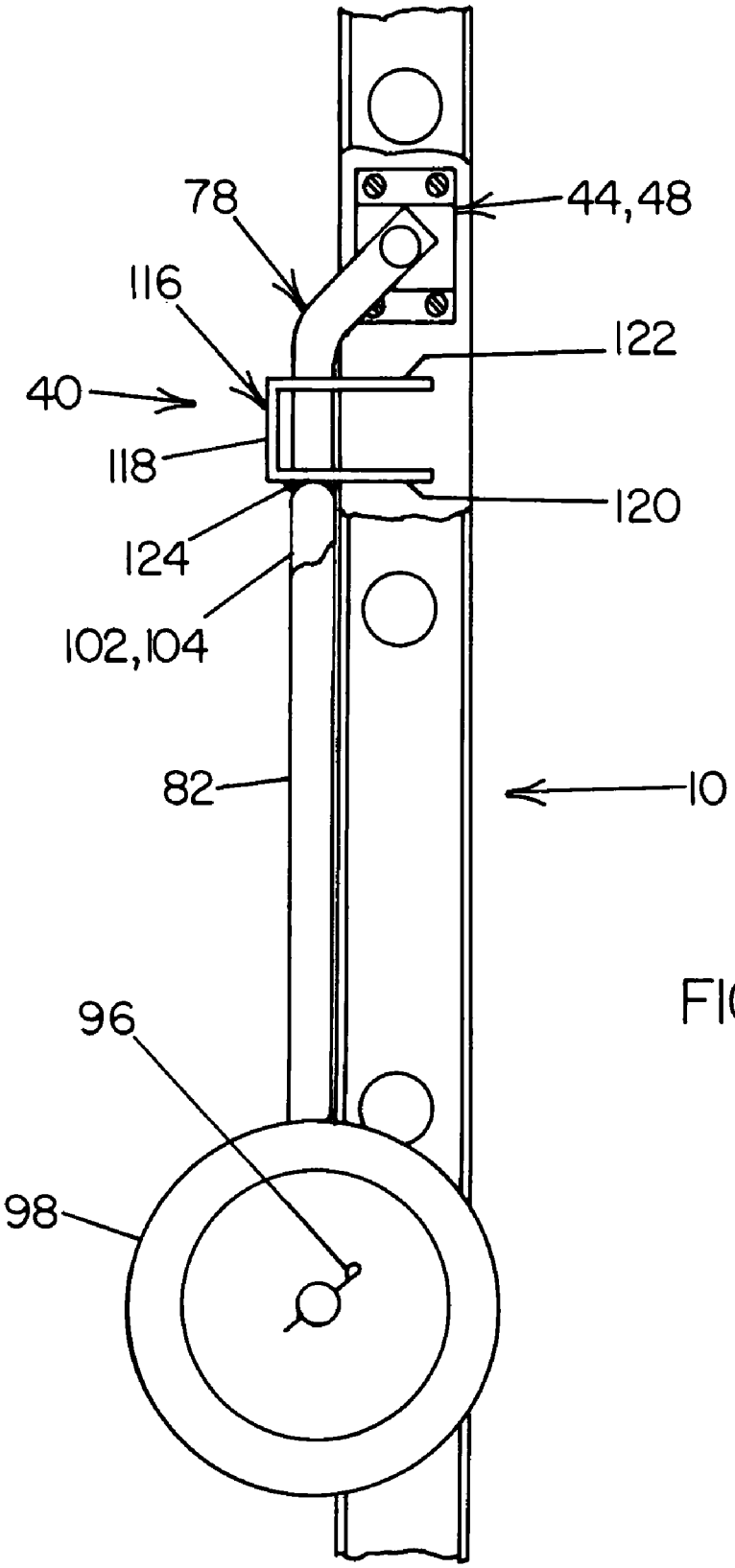
FIG. 2 is a fragmentary side elevational view of the ladder shown in FIG. 1 with portions of stile broken away to show the hidden parts thereof, and with the transportation device folded against the ladder.
Figure 3:
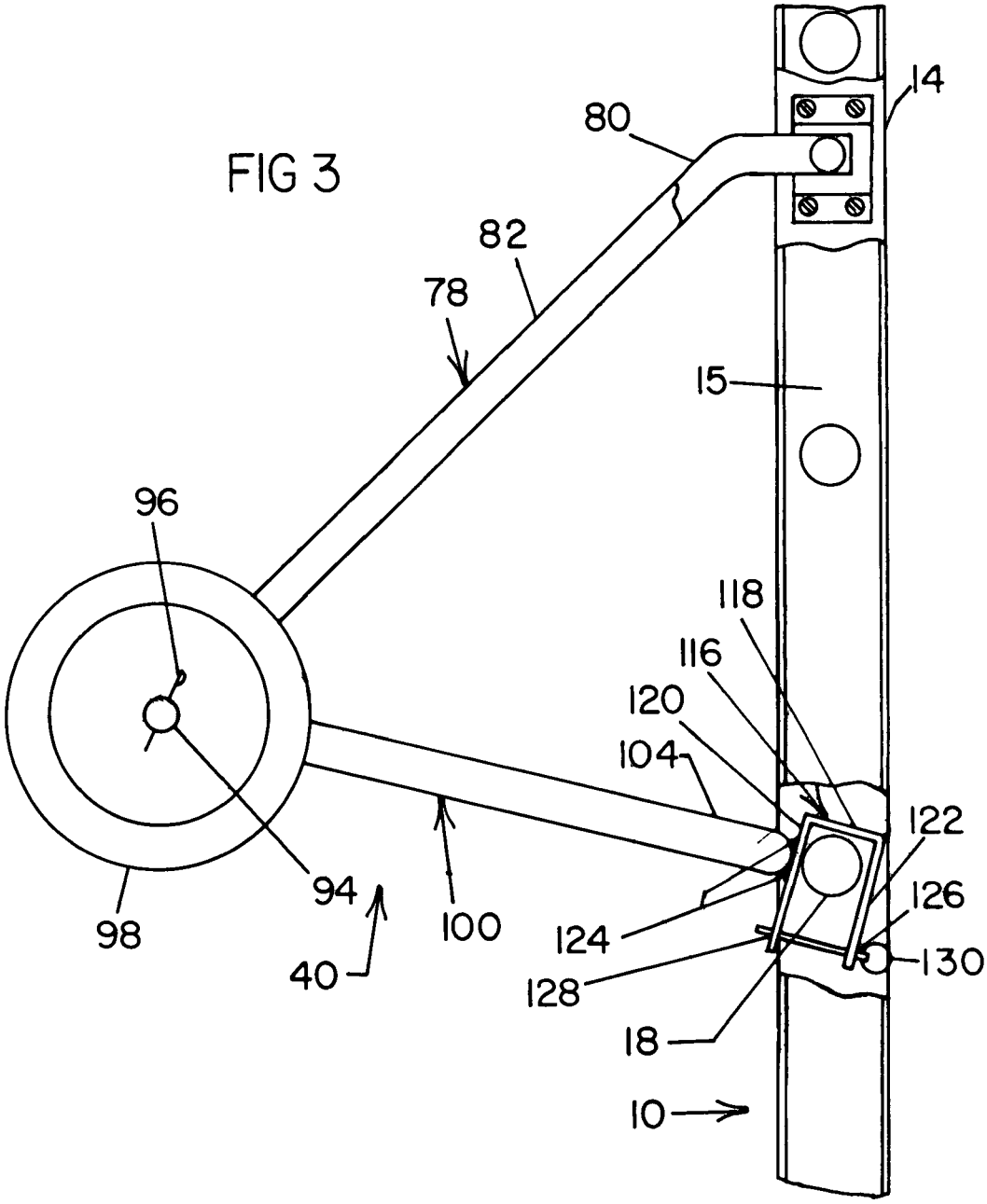
FIG. 3 is a fragmentary side elevational view of the ladder shown in FIGS. 1 and 2, with portions of a stile broken away to show the hidden parts thereof and with the device in the extended position for use to support the ladder while being moved across ground.

Referring further to FIGS. 1, 2, and 3, along the length of each of the side portions 80, 82 of the pivot arm 78 and near the outer end portion 84 are transverse holes 90, 92 that are axially aligned with each other for receiving an axle 94. The axle 94 extends parallel to the outer end portion 84 and is spaced a short distance therefrom and rotatably retained by pins 95, 96 extending through transverse holes in the opposite ends of the axle 94 are a pair of spaced apart wheels 97, 98.

The device 40 also includes a second U-shaped pivot arm 100 having parallel spaced apart side arms 102, 104 having free ends 106, 108. Extending between the ends of the side arms 102, 104 opposite the free ends 106, 108 is a transverse connecting member 110. Like the first U-shaped pivot arm 78, the second U-shaped pivot arm 100 is preferably made as a single elongate metal member having bends 112, 114 that define the ends of the connecting member 110. The distance between the outside surfaces of the side arms 102, 104 is less than the distance between the inside surfaces of side portions 80, 82 of the first U-shaped arm 78 so that the second U-shaped arm 78 is moveable between the side portions 80, 82 of the first U-shaped arm 78.

Along the length of the connecting member 110 is a U-shaped channel 116. As best seen in FIGS. 2 and 3, the U-shaped channel 116 has an elongate generally planar back 118, and extending perpendicular to the back 118 and generally perpendicular to the side arms 102, 104 are a pair of spaced apart parallel side panels 120, 122. The channel 116 is preferably attached to the connecting member 110 by welds 124 that extend along one of the side panels 120. The channel 116 also has an overall length that is less than the length of one of the rungs 18 of the ladder portion 10 so that the second pivot arm 100 can move between the side portions 80, 82 of the first U-shaped arm 78.

As shown in FIG. 1, the free ends 106, 108 of the parallel arms 102, 104 each have a transverse hole 107, 109 respectively therein oriented to rotatably receive the axle 94 such that the connecting member 110 with the channel 116 attached thereto is rotatable around the axle 94. As shown in FIG. 3, the parallel side panels 120, 122 of the channel 116 are spaced apart from each other a distance that is a little larger than the diameter of a rung 18 and the channel 116 is oriented such that the channel 116 can be fitted around one of the rungs 18 of the ladder portion 10 as shown in FIG. 2 when the first of the U-shaped arms 78, 100 is oriented to transport the ladder 10. Each of the side panels 120, 122 also has a hole 126, 128 near the distal end thereof that are axially aligned with one another to receive the shank of a locking pin 130 for removably locking the channel 116 around the rungs 18 of the ladder section 10.

As best seen in FIG. 1, three tubular spacers 132, 134, 136 surround the axle 94, the first 132 between the first wheel 97 and the first side arm 102, the second 134 between the outer ends 106, 108 of the side arms 102,104 of the second U-shaped arm 100, and the third 134 between the second side arm 104 and the second wheel 98 to thereby space the various parts. The spacers 132, 134, 136 ensure that the wheels 97, 98 will not interfere with the stiles 14, 15 when the device 40 is folded against the ladder section 10 as shown in FIG. 2.

As depicted in FIG. 2, when the ladder is being stored or being carried on a vehicle, the outer end portion 84 of the first pivot arm 78 can be pivoted around the shanks 70 of the pivot assemblies 44, 48 until the side portions 80, 82 are generally parallel to the stiles 14, 15. Also, the connecting member 110 of the second pivot arm 100 can be pivoted around the axle 94 until the side arms 102, 104 extend generally parallel to the stiles 14, 15. For transporting the ladder 10 across ground, as shown in FIGS. 3 and 6, the outer end portion 84 of the first pivot arm 78 is swung on pins 70 outward and away from the stiles 14, 15 and the connecting member 110 of the second U-shaped member 100 is pivoted around axle 94 until the open portion of the channel 116 can be fitted around one of the rungs 18 of the ladder portion 10. After the channel 116 has been fitted around a rung 18, the locking pin 130 is inserted through the holes 126, 128 in panels 120, 122 thereby locking the assembly 40 in position for use.

As shown in FIG. 6, with the U-shaped arms 78, 100 locked in position with the stile 14, 15 oriented generally parallel to the ground 41 as depicted in FIG. 3, the ladder 10 can be rolled across ground 41 on wheels 97, 98 to the point of use. It should be appreciated that while the stiles 14, 15 and the rungs 18-18 of the ladder are generally parallel to the ground, the rungs 18-18 and stiles 14, 15 form a carrying surface upon which tools and other material 115, 117, 119 can be placed and transported to or from the work site. Referring to FIG. 7, once the point of use is reached, the operator can walk his hands across the rungs 18 from one end of the ladder to raise the ladder into the position needed against a structure causing the wheels 97, 98 to be lifted off the ground 41. Thereafter, locking pin 130 can be removed which the outer end portion 84 and the second U-shaped arm 100 may be left to hang by the ends 74, 76 of the U-shaped arm 78. With the parts hanging free of the stiles 14, 15, neither the wheels 97, 98 nor the U-shaped arm 100 will interfere with one using the ladder 10. When the ladder 10 is no longer needed, the channel 116 can be again reassembled to the rung 18 and locked in place with the pin 130 and the device 40 can again assist in transporting the ladder 10 back to a service vehicle, or place of storage.

Figure 8:
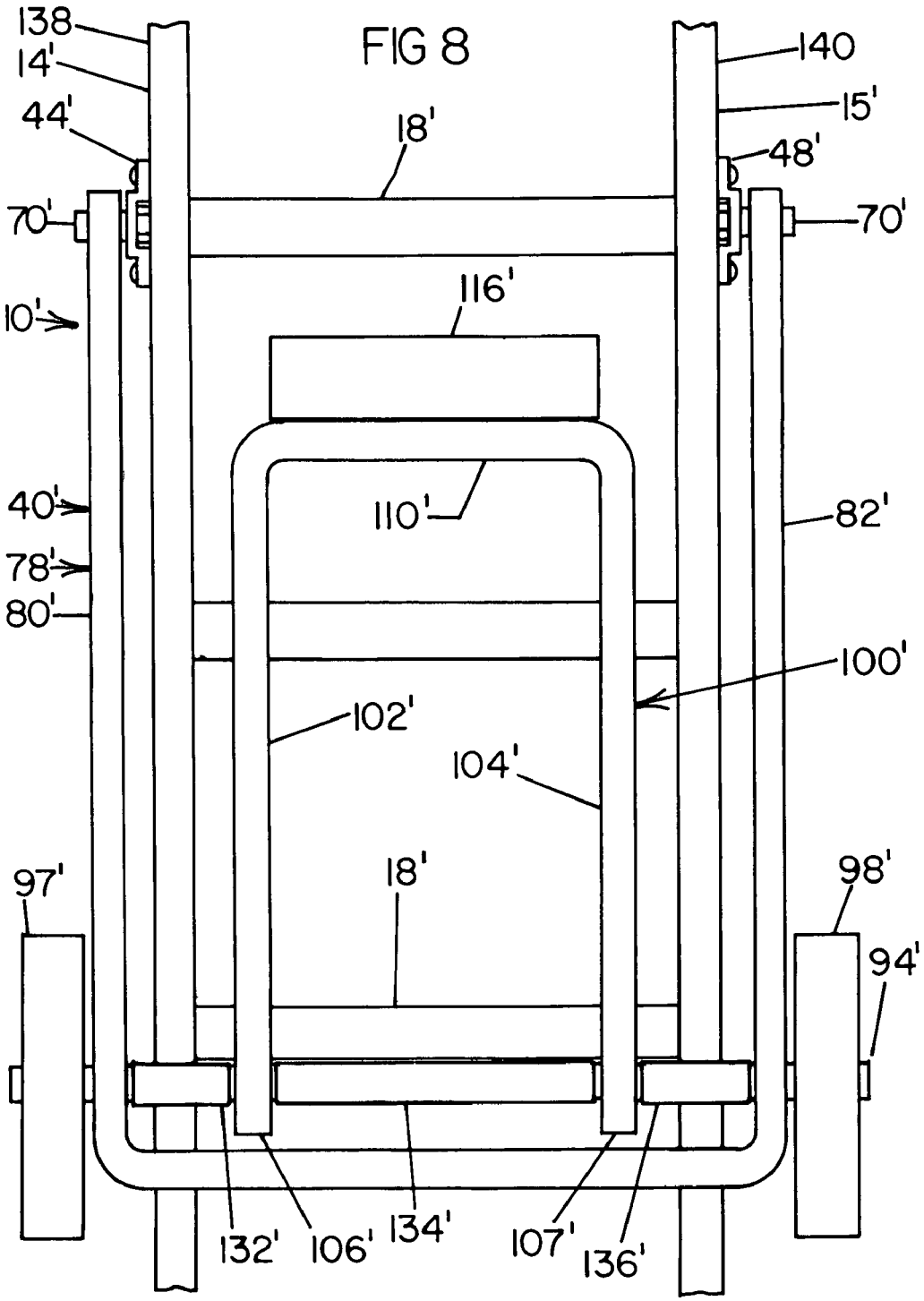
FIG. 8 is a fragmentary front elevational view of a ladder having a second embodiment of the transportation device attached thereto.
Figure 9:
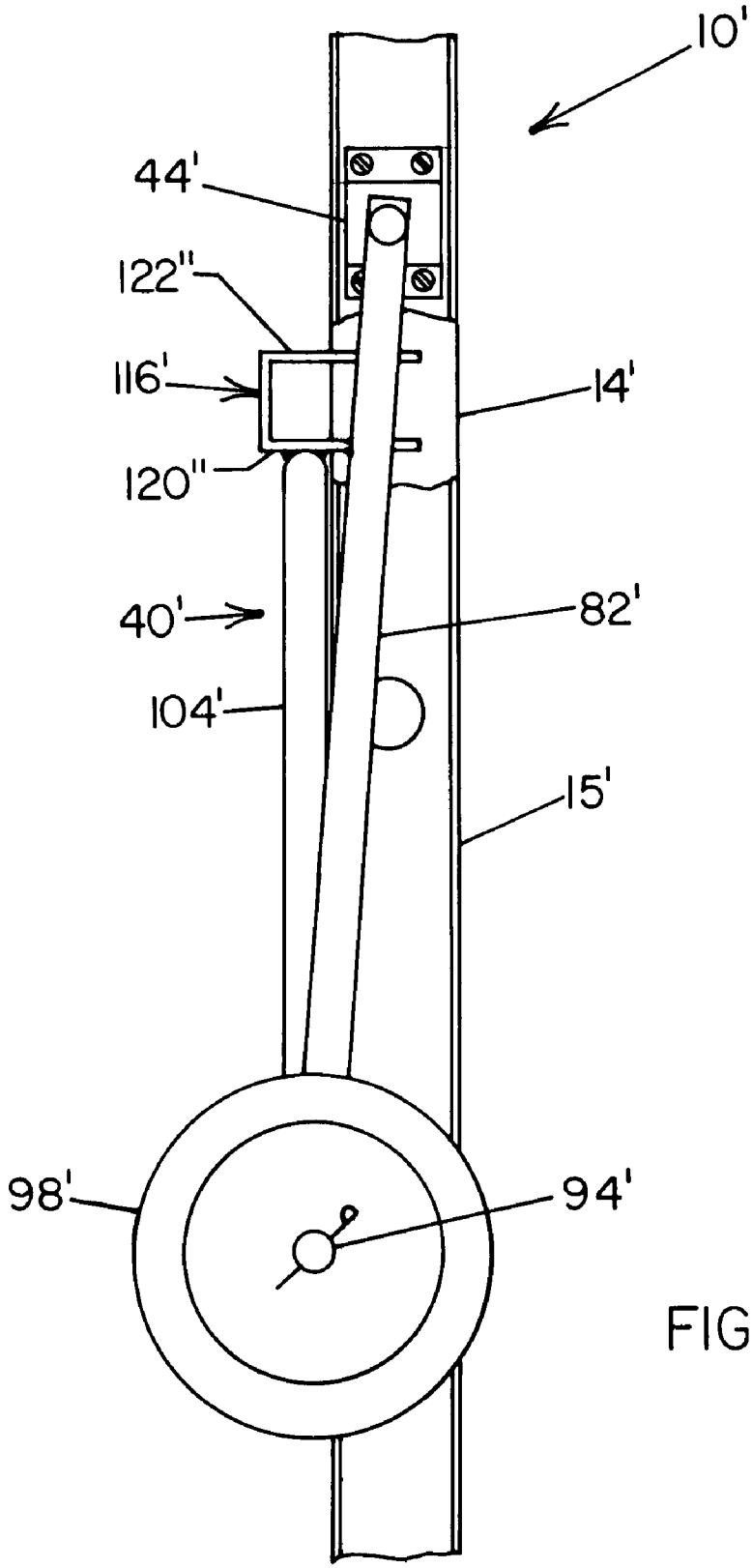
FIG. 9 is a fragmentary side elevational view of the ladder and transportation device shown in FIG. 8 with portions of a stile broken away to show the hidden parts thereof.

Referring to FIGS. 8 and 9, a second embodiment of the transporting device 40' has many parts thereof that are identical to or very similar to the parts of the first embodiment 40 and parts of the second embodiment 40' that are like the parts of the first embodiment 40 bear like indicia numbers except they are primed. In this embodiment, the first and second side arms 102', 104' are fitted outward of opposite outer surfaces 138, 140 of the stiles 14', 15' and are pivotally retained thereto by pivot pins 70' mounted on pivot mountings 44', 48' as was provided for the first embodiment. In this embodiment, spacers 132', 134', 136' are fitted around the axle 94' with the first spacer 132' positioned between the outer end of the first side arm 80' of the first U-shaped arm 78' and the free end 106' of the second U-shaped arm 100, the second spacer sleeve 134' positioned between the two free ends 106', 108' of the second U-shaped pivot arm 100', and the third spacer 136' between the second free end 108' of the U-shaped arm 100' and the outer end 76' of the second side portion 82' of the first U-shaped arm 78'. The spacers 132', 134', 136' therefore ensure that the connecting member 110' and the channel 116' of the second U-shaped arm 100' fits between the stiles 14', 15' so as to easily engage one of the rungs 18'.

Figure 10:
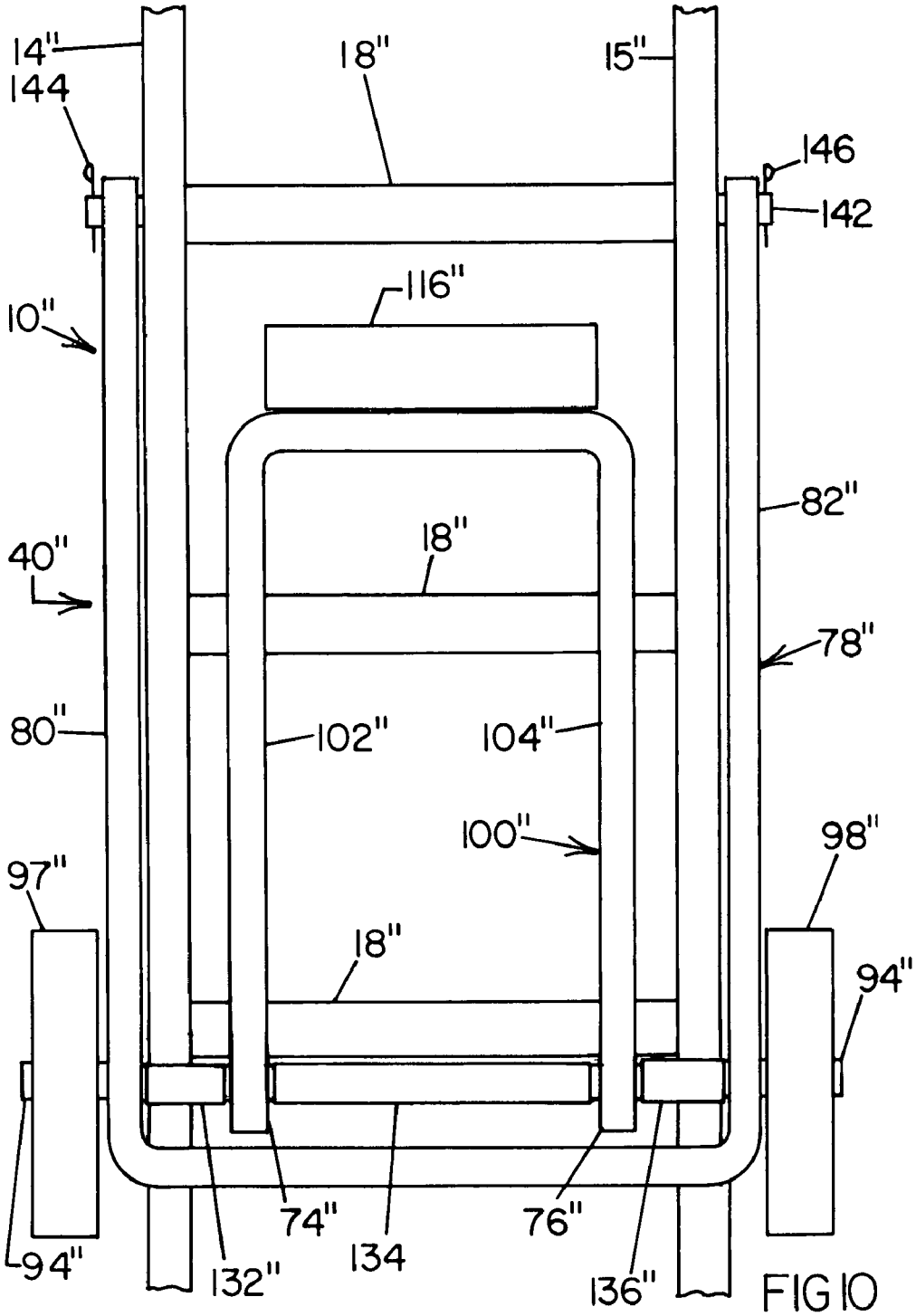
FIG. 10 is a fragmentary front elevational view of a ladder having a third embodiment of the transportation device attached thereto.
Figure 11:
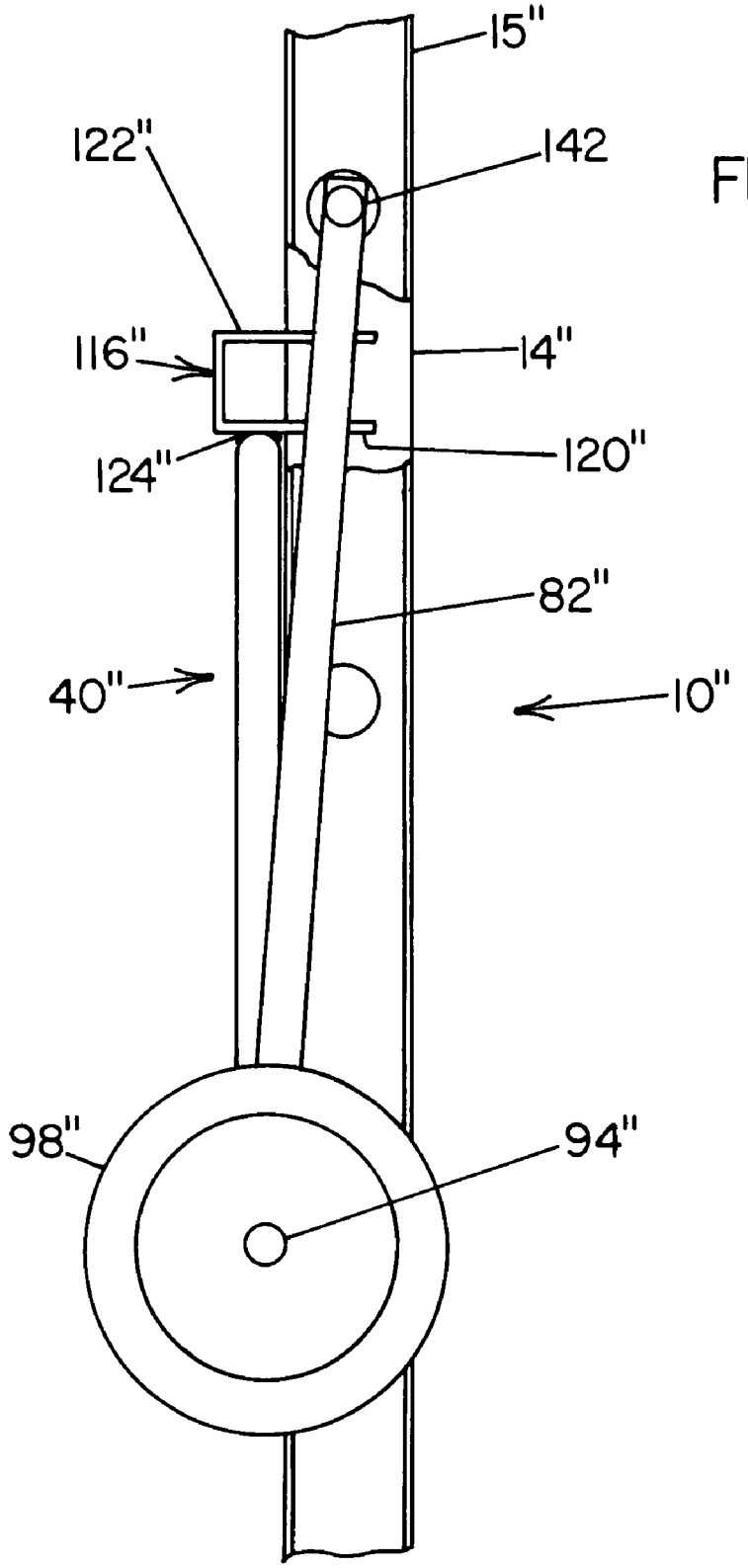
FIG. 11 is a fragmentary side elevational view of the ladder and device shown in FIG. 10 with portions of one stile broken away to show the elements of the device.
Figure 12:
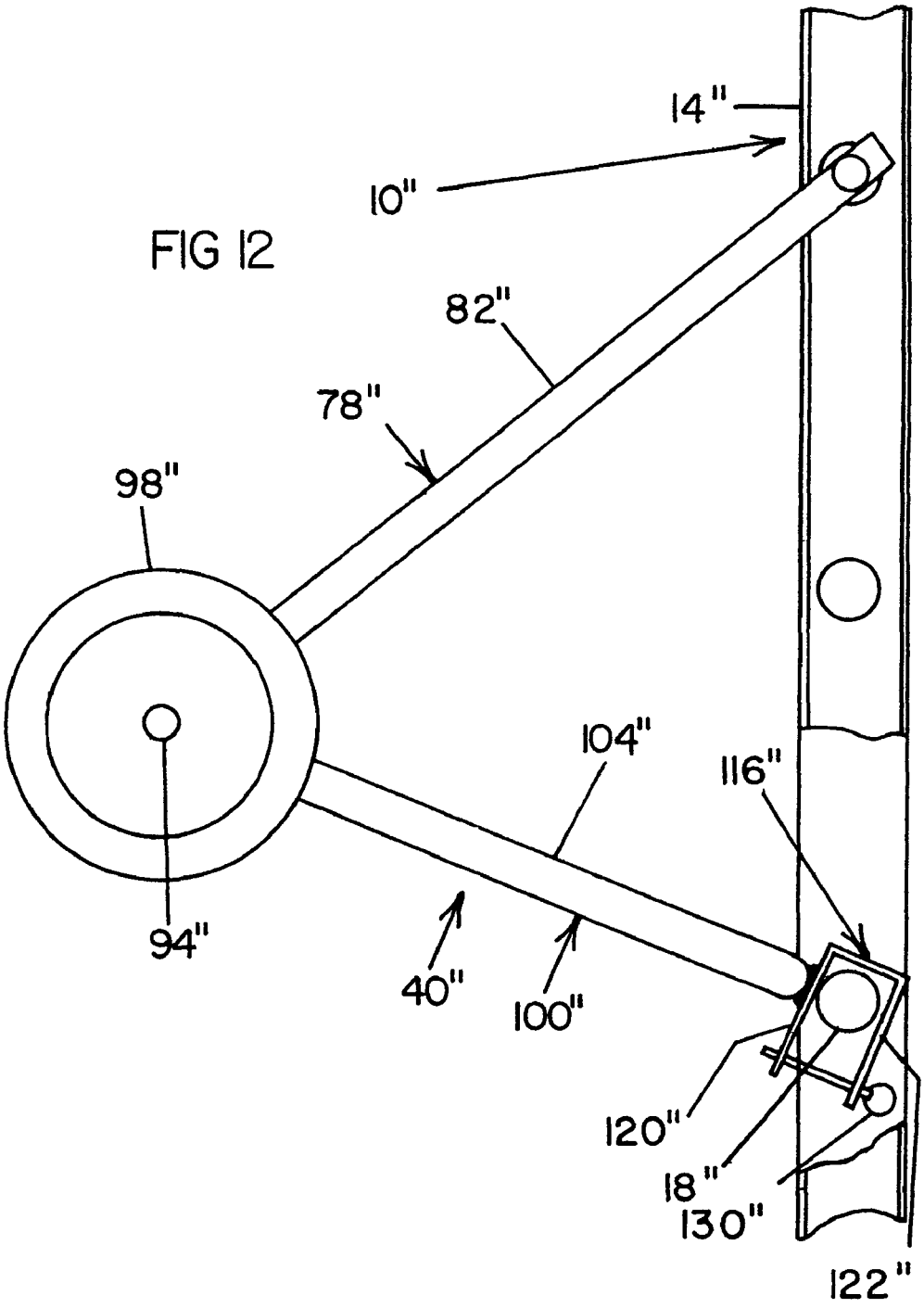
FIG. 12 is another fragmentary side elevational view of the ladder and device shown in FIG. 10 with portions of one of the stiles broken away.

Referring to FIGS. 10, 11, and 12 a third embodiment of the device 40" has parts that are like parts of both the first embodiment 40 and the second embodiment 40', and those parts that are like parts of a previous embodiment bear like indicia numbers except that they are double primed. In this embodiment, the rungs 18" of the ladder 12" are hollow and a shaft 142 extends through the central opening of one of the tubular rungs 18" with the distal ends of the shaft 142 extending outward of the two outer surfaces 138, 140 and extend through transverse holes, not visible, near the free ends 74", 76" of the first U-shaped pivot arm 78." Retaining pins 144, 146 near each of the distal ends of the shaft 142 retain the ends 74", 76" to the U-shaped arm 78" from disconnecting from the shaft 142.

Figure 13:
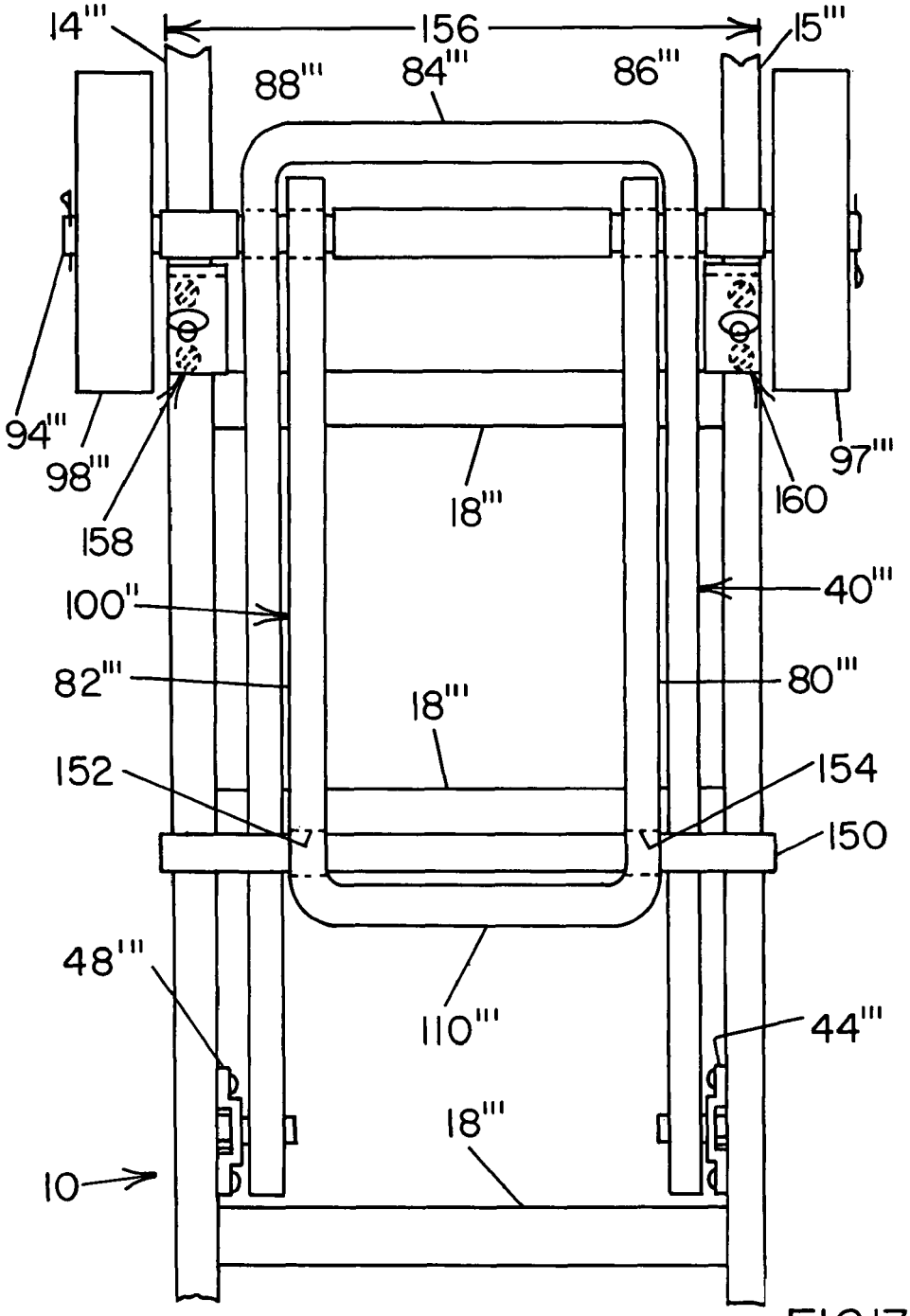
FIG. 13 is a fragmentary front elevational view of yet another embodiment of a ladder having a transporting device in accordance with the invention.
Figure 14:
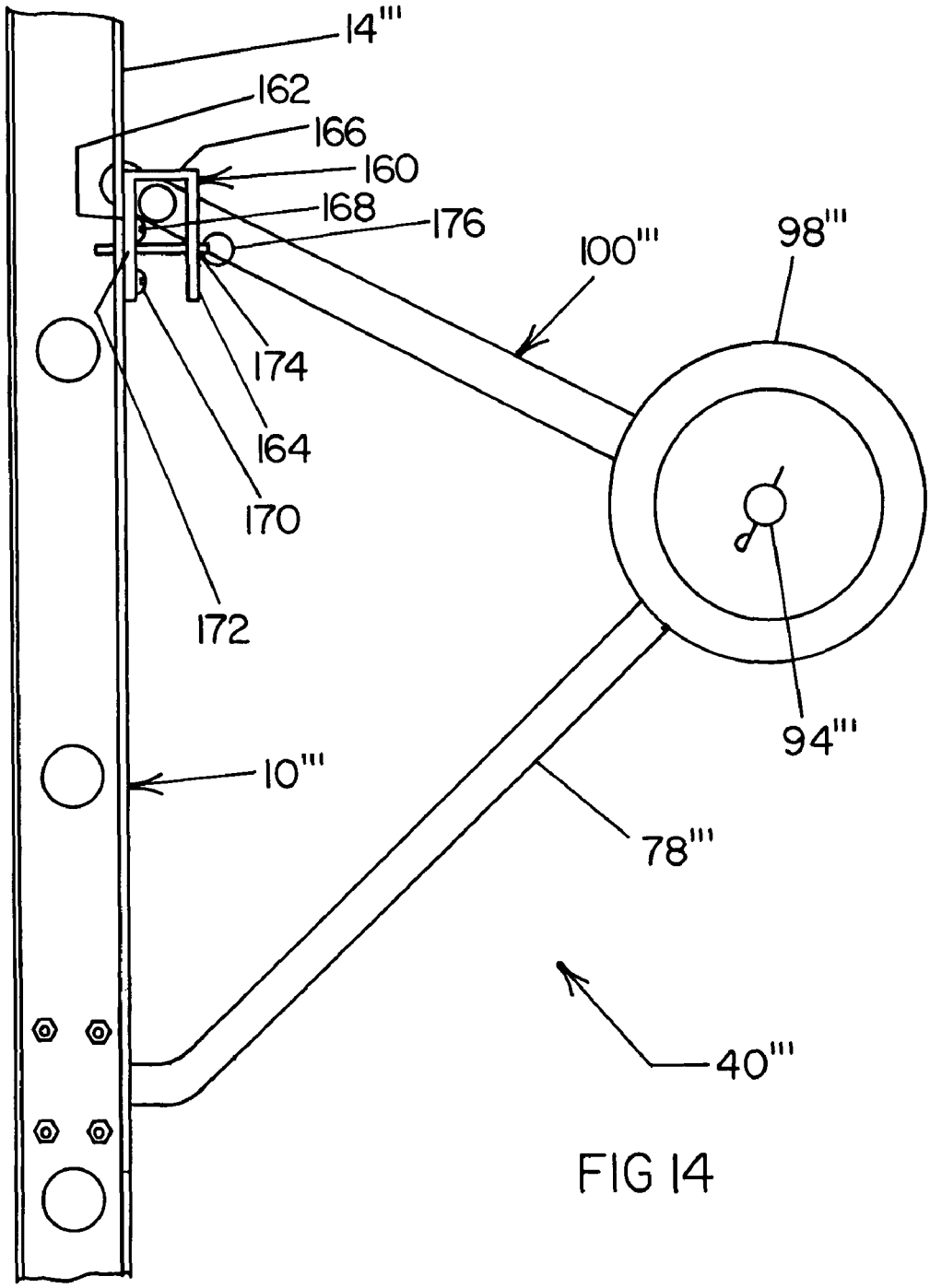
FIG. 14 is a fragmentary side elevational view of the ladder and device shown in FIG. 13 with portions of one of the stiles broken away.

Referring to FIGS. 13 and 14, another embodiment 40'" of a transportation device 40 has parts that are more similar to the parts of the first embodiment 40 than to any of the others and therefore, the parts that are like the parts of the first embodiment 40 bear like indicia numbers except they are triple primed. In this embodiment, the second U-shaped pivot arm 100 does not have a channel the equivalent of channel 116 attached to the connecting member 110'" as does the embodiment 40. In its place, the transportation device 40'" has an elongate retaining bar 150 that is fitted through a pair of apertures 152, 154 in first and second side arms 102'", 104'" respectively, the apertures 152, 154 being positioned near the connecting member 110'". The retaining bar 150 has an overall length that is a little longer than the overall width 156 between the outer surfaces of the stiles 14'", 15'" and the retaining bar 150 is welded into the apertures 152, 154 with the two distal ends of the retaining bar 150 extending an equal distance outward of the outer sides of the first and second side arms 102'", 104'" respectively. Accordingly, the connecting bar 150 extends perpendicularly to the stiles 14'", 15'" and intersects the planes of the outer surfaces of the stiles 14'", 15'".

Mounted on each of the stiles 14'", 15'" are a pair of U-shaped connecting hooks 158, 160. Each of the connecting hooks 158, 160 of which hook 160 is clearly visible in FIG. 14 is representative of both hooks 158, 160. Hook 160 has a generally planar base portion 162, and spaced from the base portion a generally parallel support portion 164 with the base portion 162 and support portion 164 retained to each other by a back portion 166. The support portion 164 is spaced from the base portion 162 by a distance that is greater than the diameter of the retaining bar 150. The connecting hooks 158, 160 are joined to their respective stiles 14'", 15'" by a pair of retaining screws 168, 170. In this embodiment, the outer end of the second U-shaped arm 100'" is retained to the stiles 14'", 15'" of the ladder 10'" when ends of the retaining bar 150 are engaged between the parallel members 162, 164 of the connecting hooks 158, 160. Each of the hooks 158, 160 has a pair of aligned holes 172, 174 therein for receiving the shank of a retaining pin 176 for locking the distal ends of the retaining bar into each of the connecting hooks 158, 160. The pivoting outer end of the second U-shaped arm 100'" is therefore retained to the ladder 10'" by engaging the connecting hooks 158, 160 on the stiles 14'", 15'" of the ladder 10'" rather than by engaging a rung of the ladder.

While the present invention has been described with respect to four embodiments, it will be appreciated that many modifications and variations may be made without departing from the true spirit and scope of the invention. It is therefore the intent of the appended claims to cover all such modifications and variations that fall within the true spirit and scope of the invention.

What is claimed is:

1. A ladder comprising a pair of generally parallel stiles, a plurality of rungs extending between said stiles, a first U-shaped member having first and second spaced apart side arms each having a first free end and a second end wherein said second end of said first and second arms are joined to each other by a first transverse connecting member, said first free end of said first side arm pivotally connected to one of said stiles adjacent to one of said rungs and said first free end of said second side arm pivotally connected to another of said stiles adjacent to said one of said rungs, a second U-shaped member having a third and a fourth spaced apart side arm each having a first free end and a second end wherein said second ends of said third and fourth arms are joined to each other by a second transverse connecting member, an axle extending through said second ends of said first and second side arms and through said first ends of said third and fourth side arms, a wheel at each end of said axle, and said second transverse connector having a channel connected thereto, said channel removably attachable to another of said rungs without the use of tools wherein said second transverse member may be attached to said another of said rungs for rolling said ladder across ground on said wheels, and disconnected from said one of said rungs when said wheels are not needed.

2. The ladder of claim 1 wherein said free end of said first and second side arms are rotatably attached near a middle of said one of said stiles.

3. The ladder of claim 1 and further comprising a bracket on each one of said stiles, and one of said first free ends of said first and second side arms is rotatably attached to a respective one of said bracket.

* * * * *